US009201374B2

(12) United States Patent
Umetsu

(10) Patent No.: US 9,201,374 B2
(45) Date of Patent: Dec. 1, 2015

(54) IMAGE FORMING APPARATUS

(71) Applicants: Kabushiki Kaisha Toshiba, Tokyo (JP); Toshiba Tec Kabushiki Kaisha, Tokyo (JP)

(72) Inventor: Toshiyuki Umetsu, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/014,070

(22) Filed: Aug. 29, 2013

(65) Prior Publication Data

US 2014/0205339 A1 Jul. 24, 2014

(30) Foreign Application Priority Data

Jan. 18, 2013 (JP) ..... 2013-007716

(51) Int. Cl.
*G03G 15/20* (2006.01)
*G03G 15/00* (2006.01)
*G03G 21/00* (2006.01)

(52) U.S. Cl.
CPC ..... *G03G 15/6585* (2013.01); *G03G 15/2014* (2013.01); *G03G 21/00* (2013.01)

(58) Field of Classification Search
CPC ..... G03G 21/00
USPC ..... 399/341
See application file for complete search history.

(56) References Cited

U.S. PATENT DOCUMENTS 5,605,777 A * 2/1997 Ando ..... B41M 7/0009 399/343
6,189,173 B1 * 2/2001 Saito ..... B41J 11/00 15/102
8,231,760 B2 * 7/2012 Murakami ..... B41M 7/0009 156/240
2009/0154970 A1 * 6/2009 Yoshida ..... G03G 15/6588 399/341
2010/0196063 A1 * 8/2010 Iguchi ..... B41J 3/546 399/322
2011/0262197 A1 10/2011 Imamiya et al.

FOREIGN PATENT DOCUMENTS

JP H10-247049 9/1998
JP 2010-139856 6/2010
JP 2011-191545 A 9/2011

OTHER PUBLICATIONS

Office Action mailed Nov. 18, 2014, filed in corresponding Japanese Patent Application No. 2013-007716, with English translation.

* cited by examiner

*Primary Examiner* — Anthony Nguyen
(74) *Attorney, Agent, or Firm* — Patterson & Sheridan, LLP

(57) ABSTRACT

According to one embodiment, an image forming apparatus having an image erasing function to erase an image formed on a recording medium. The apparatus has a heating unit to erase an image, a conveying unit, and a control unit. The control unit controls the conveying unit, when the image is erased, and also when a heating temperature of the heating unit is lower than an erasing temperature, to make the recording medium once stand by at a position in the middle of a conveying path of the conveying unit, and then to convey the recording medium to the heating unit.

10 Claims, 6 Drawing Sheets

IMAGE FORMING APPARATUS

CROSS-REFERENCE TO RELATED APPLICATION

This application is based upon and claims the benefit of priority from Japanese Patent Application No. 2013-7716, filed on Jan. 18, 2013, the entire contents of which are incorporated herein by reference.

FIELD

Exemplary embodiments described herein generally relate to an image forming apparatus which is provided with a function to form an image on a recording medium and a function to erase an image formed on a recording medium.

BACKGROUND

An image forming apparatus which prints an image such as a character and a figure on a recording medium such as a sheet using erasable coloring material is proposed. In addition, an apparatus having an image erasing function in the image forming apparatus like this is proposed.

An image forming apparatus having an image erasing function (hereinafter, simply called an image forming apparatus) forms an un-fixed toner image on a sheet with an electrographic system which uses erasable toner as erasable coloring material. When fixing the un-fixed toner image on the sheet (hereinafter, called a fixing mode), the image forming apparatus has a heating unit as a fixing unit which heats the un-fixed toner image to a prescribed fixing temperature and pressurizes the image. In the image forming apparatus, when the image printed on the sheet is erased (hereinafter, called an erasing mode), the heating unit functions also as an image erasing unit. The heating unit heats the toner image printed on the sheet at an erasing temperature higher than the fixing temperature, to erase the color of the toner image, or to make the color of the toner image transparent.

The heating unit keeps a heating temperature at the time of standby to the fixing temperature or a temperature close to the fixing temperature in the fixing mode, so as to perform a fixing operation without making a user wait. Accordingly, even if the erasing mode is selected by a user in the image forming apparatus, the image forming apparatus can not pass a sheet that is a target for image erasing to the heating unit until the heating temperature of the heating unit reaches from the fixing temperature to the erasing temperature.

DETAILED DESCRIPTION

Figure 1:
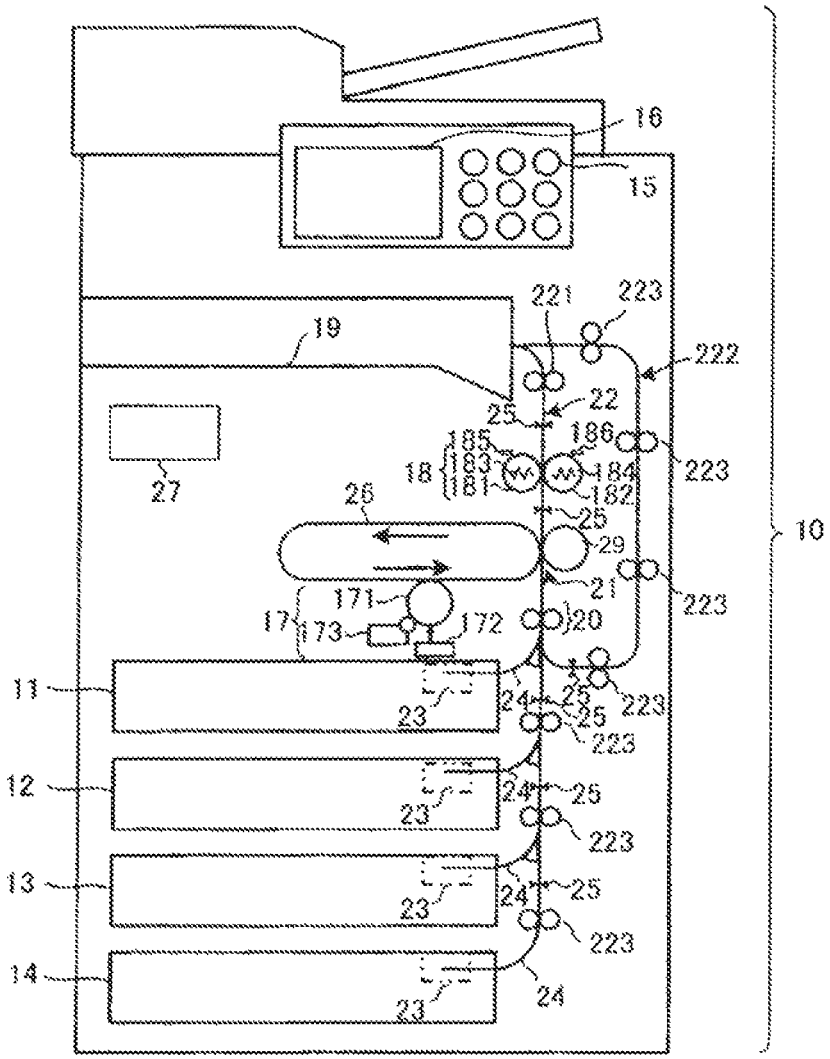
FIG. 1 is a sectional view showing a main portion of an image forming apparatus according to an embodiment.

According to one embodiment, an image forming apparatus having a function to form an image on a recording medium and a function to erase an image formed on a recording medium is provided. The image forming apparatus has an image forming unit, a heating unit, a conveying unit, and a control unit. The image forming unit forms an image with coloring material whose color is erasable. The heating unit, when the image formed by the image forming unit is fixed on a recording medium, heats the image at a fixing temperature, and when color of an image previously fixed on a recording medium is erased, heats the image at an erasing temperature higher than the fixing temperature. The conveying unit conveys the recording medium to the heating unit through a prescribed conveying path. The control unit controls the conveying unit so that when the color of the image is erased, and also when a heating temperature of the heating unit is lower than the erasing temperature, the recording medium is made to once stand by at a specific standby position at a more upstream side in a direction of conveying the recording medium than the heating unit, and after the standby, the recording medium is fed from the specific standby position to the heating unit.

Hereinafter, further embodiments will be described with reference to the drawings. In the drawings, the same symbols indicate the same or similar portions.

Figure 2:
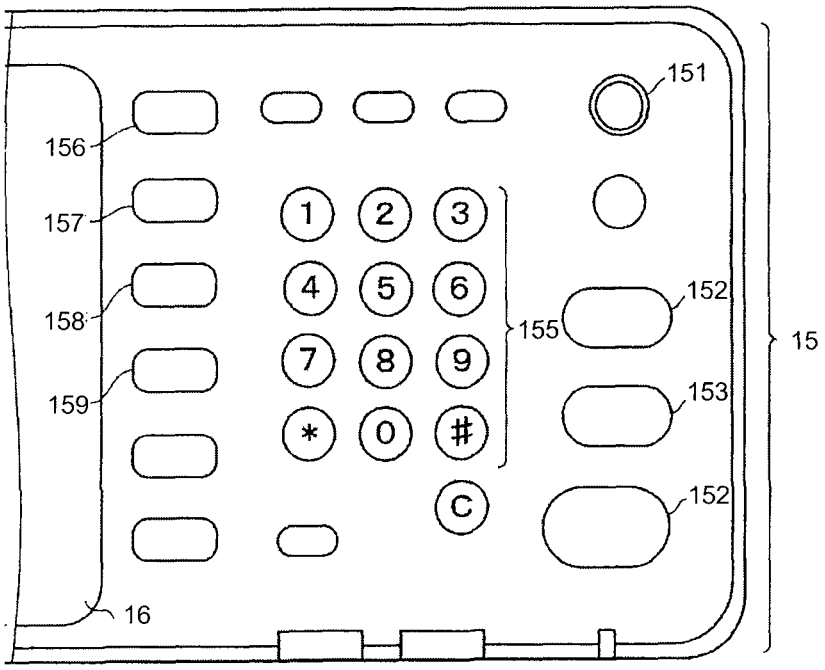
FIG. 2 is a view showing the operation unit of the image forming apparatus according to the embodiment.
Figure 3:
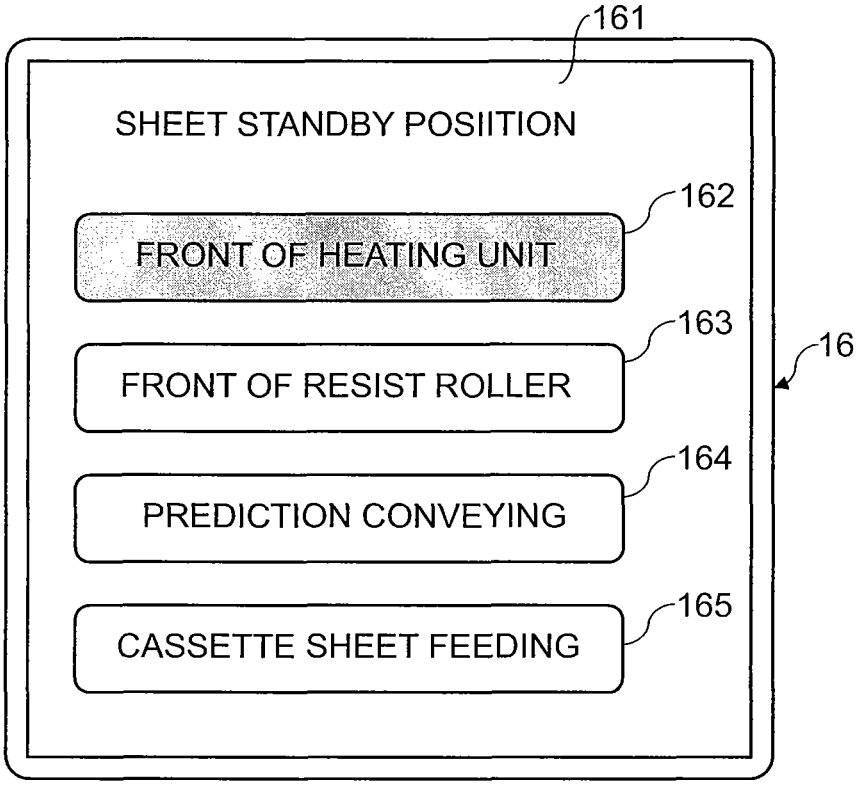
FIG. 3 is a view showing a sheet standby position designating screen displayed on the display unit of the image forming apparatus according to the embodiment.
Figure 4A:
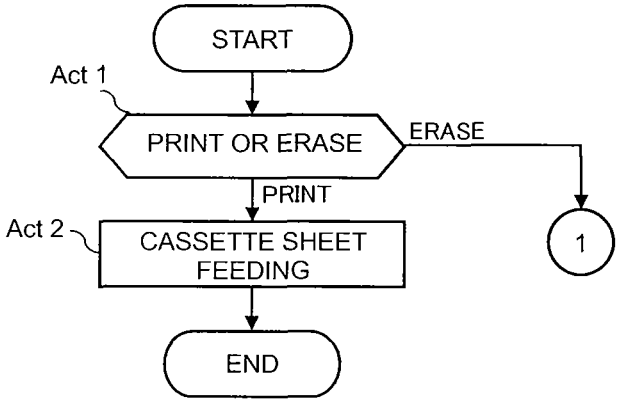
FIGS. 4A-4E are flow charts showing conveying control of a sheet in an image forming mode and an image erasing mode of the image forming apparatus according to the embodiment.
Figure 4B:
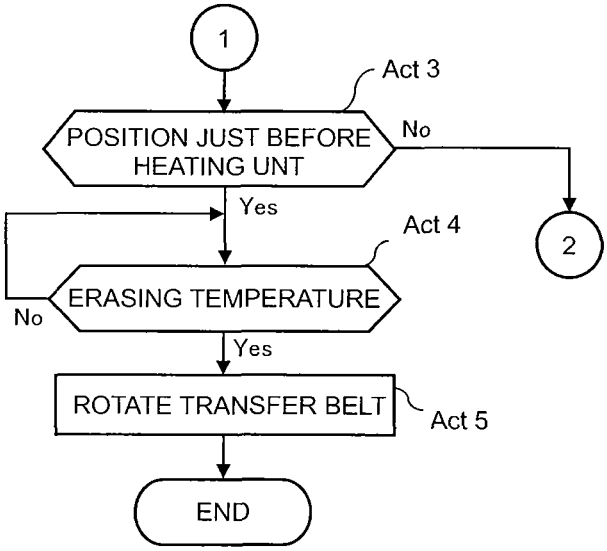
Figure 4C:
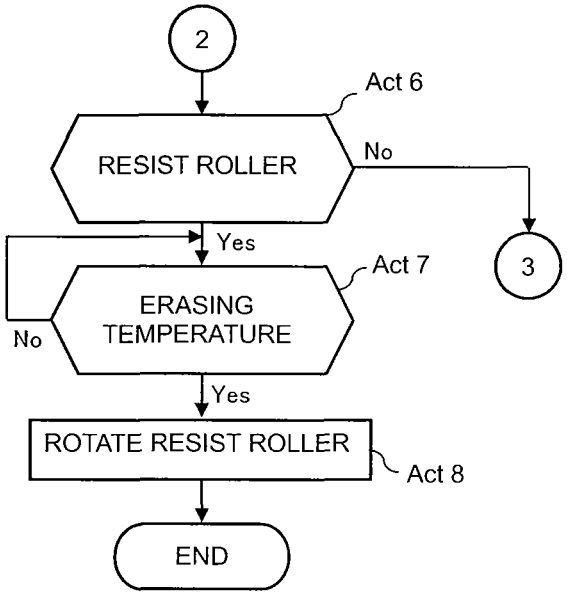
Figure 4D:
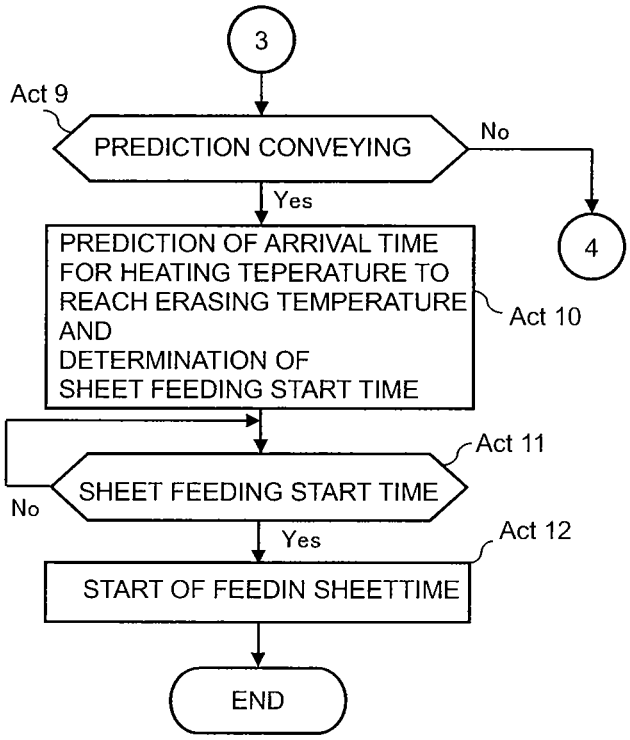
Figure 4E:
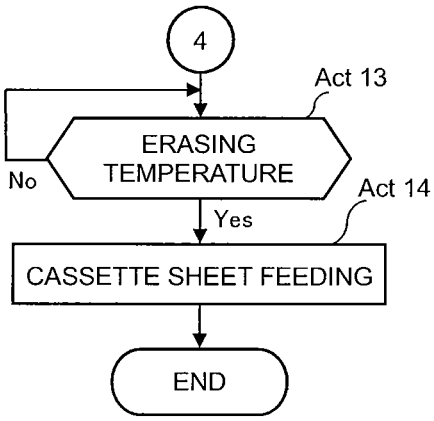

An embodiment will be described with reference to FIG. 1 to FIG. 3. FIG. 1 is a sectional view showing a main portion of an image forming apparatus of the embodiment. FIG. 2 is a view showing an example of the operation unit of the image forming apparatus of the embodiment. FIG. 3 is a view showing a sheet standby position designating screen displayed on the display unit of the image forming apparatus of the embodiment.

As shown in FIG. 1, an image forming apparatus 10 is a multi function peripheral having a copy function, a printer function, a scanner function, and so on. The image forming apparatus 10 prints an image on a sheet using erasable coloring material, such as erasable toner with an electrophotographic system. The image forming apparatus 10 further erases the color of an image which has been printed on a sheet using erasable coloring material, or performs erasing processing to make the color of the image transparent. The erasable coloring material includes color developing compound, color developer, and color erasing agent. As the color developing compound, leuco dye is quoted, for example. As the color developer, phenols are quoted, for example. As the color erasing agent, material which is compatible with the color developing compound and does not have affinity with the color developer, when heated is quoted. The erasable coloring material generates color by mutual interaction with the color developing compound and the color developer, and since the mutual interaction with the color developing compound and the color developer is cut when heated not more than a color erasing temperature, the color is erased. In the embodiment, a case in which an image is printed with erasable toner, and a case in which an image which has been printed with erasable toner is erased will be described as examples.

The image forming apparatus 10 has sheet feeding cassettes 11, 12. The sheet feeding cassettes 11, 12 house a recycled sheet from which an image has been erased or a new sheet. The image forming apparatus 10 takes out a sheet from any one cassette of the sheet feeding cassettes 11, 12, and prints an image on the sheet using erasable toner. The image forming apparatus 10 has sheet feeding cassettes 13, 14. The sheet feeding cassettes 13, 14 house a sheet which has been printed with erasable toner, as a sheet from which color of the image is to be erased. The image forming apparatus 10 takes out a sheet from any one sheet feeding cassette of the sheet feeding cassettes 13, 14, and performs erasing processing to the sheet.

The image forming apparatus 10 has an operation unit 15, a display unit 16, an image forming unit 17, a pair of resist rollers 20, a heating unit 18 to perform both fixing and erasing functions, a sheet discharge roller 221, and a sheet discharge unit 19. In addition, the image forming apparatus 10 has a conveying path 22 to guide a sheet taken out from the sheet feeding cassettes 11-14 to the sheet discharge unit 19 through the resist rollers 20, a secondary transfer position 21, and the heating unit 18. The image forming apparatus 10 has an inverting conveying path 222 arranged between the resist rollers 20 and the sheet discharge roller 221 so as to perform duplex printing. The image forming apparatus 10 has conveying rollers 223 arranged on the conveying path 22 at appropriate intervals. The conveying rollers 223, along with sheet feeding units 23, the resist rollers 20, a transfer belt 26, a secondary transfer roller 29, a heating roller 181, a pressure roller 182, and the sheet discharge roller 221 constitutes a conveying unit. The conveying unit conveys the sheet guided in the conveying path 22. The image forming apparatus 10 has sheet feeding units 23 and branch conveying paths 24 provided with a pickup roller and a sheet feeding and separating roller. The sheet feeding unit 23 takes out sheets in the respective one of the sheet feeding cassettes 11-14 one by one. The branch conveying path 24 guides the sheet taken out by the sheet feeding unit 23 to the conveying path 22. The image forming apparatus 10 has sheet detecting sensors 25 each of which detects a front edge position of the sheet conveyed from the branch conveying path 24 to the conveying path 22.

The resist rollers 20 are made contact with a front edge of the conveyed sheet, while the rotation thereof is stopped, to adjust the tilt of the sheet. The resist rollers 20 rotate to transfer the sheet to the secondary transfer position 21 in accordance with the toner image forming timing of the image forming unit 17. The image forming unit 17 has a photo conductor drum 171, an exposure unit 172, and a developing unit 173. The photo conductor drum 171 is uniformly charged by a charging unit (not shown) before exposed by the exposure unit 172. The exposure unit 172 exposes the photo conductor drum 171 based on the information of an image to be printed, to form an electrostatic latent image on the photo conductor drum 171. The developing unit 173 develops the electrostatic latent image formed on the photo conductor drum 171 using erasable toner, to form a toner image on the photo conductor drum 171. The toner image formed on the photo conductor drum 171 is electrostatically absorbed to the transfer belt 26, to be primarily transferred. The transfer belt 26 runs with the toner image being supported, to convey the toner image to the secondary transfer position 21. The secondary transfer roller 29 transfers the toner image on the transfer belt 26 to the sheet at the secondary transfer position 21.

The heating unit 18 has the heating roller 181 and the pressure roller 182 which contacts the heating roller 181 with pressure. The sheet which has passed through the secondary transfer position 21 is passed through a nip portion formed between the heating roller 181 and the pressure roller 182. The heating unit 18 has an image fixing function to heat an un-fixed toner image to a fixing temperature and pressurize the image with the heating roller 181 and the pressure roller 182, to fix the un-fixed toner image to a sheet. In addition, the heating unit 18 has an image erasing function to heat a toner image of a printed sheet to an erasing temperature and pressurize the image with the heating roller 181 and the pressure roller 182, to erase the toner image of the sheet. The erasing temperature is a temperature higher than the fixing temperature. The heating roller 181 and the pressure roller 182 have heaters 183, 184 in the respective inner portions so as to perform image fixing and image erasing. The heating temperature of the heating unit 18 is kept to a standby temperature in the standby state by a control unit 27 described later. The standby temperature is a temperature equal to the fixing temperature or a temperature close to the fixing temperature. In the embodiment, the standby temperature is the temperature equal to the fixing temperature, for example. The standby state is a state in which the heating unit 18 is not performing fixing an image and erasing an image. In other words, the standby state is a state in which the image forming apparatus 10 is not performing an image forming operation and an image erasing operation. The image forming apparatus 10 in the standby state can accept a print instruction and an erasing instruction by a user through the operation unit 15.

The control unit 27 controls the image forming unit 17, the heating unit 18 and so on, based on user's designation of any one mode out of an image forming mode and an image erasing mode, to perform an image forming operation or an image erasing operation. The operation unit 15 accepts user's designation such as the image forming mode, the image erasing mode, in cooperation with the display unit 16. The operation unit 15 has various buttons so as to accept a user's designation. For example, as shown in FIG. 2, the operation unit 15 has a power source button 151, a reset button 152, a stop button 153, a start button 154, a numerical keypad 155, a menu button 156, an erasing button 157 to designate the image erasing mode, a scan button 158, a print button 159 to designate the image forming mode, and so on. The operation unit 15 accepts the designation of the image forming mode by the user's operation of the print button 159, for example. In addition, the operation unit 15 accepts a start instruction of the image forming mode by the user's operation of the start button 154. In addition, the operation unit 15 accepts the designation of the image erasing mode by the user's operation of the erasing button 157, for example. In addition, the operation unit 15 accepts a start instruction of the image erasing mode by the user's operation of the start button 154.

The control unit 27 has a processor composed of a CPU (Central Processing Unit) or an MPU (Micro Processing Unit), and a memory. The memory is a semiconductor memory, for example, and is composed of a ROM (Read Only Memory) to store various control programs and a RAM (Random Access Memory) to provide a temporary working area to the processor.

The control unit 27 drives driving motors of the image forming unit 17, the heating unit 18, and the conveying unit, and so on, in accordance with the designation of the image forming mode or the erasing mode, and the start instruction which the instruction unit 15 has accepted. In addition, the control unit 27 controls the conveying unit by driving the driving motors, to make the sheet stand by at a standby position described later, and to make the sheet to be fed from the standby position.

In addition, the control unit 27 performs energization control of the heaters 183, 184 in accordance with the image forming mode and the color erasing mode, based on the detection information of the temperature sensors 185, 186 which detects the respective temperatures of the heating roller 181 and the pressure roller 182. The control unit 27 performs energization control of the heaters 183, 184, to control the heating unit 18 so that the heating temperature by the heating roller 181 and the pressure roller 182 becomes the fixing temperature or the color erasing temperature. In addition, the control unit 27 performs energization control of the heaters 183, 184, to control the heating unit 18 so that the heating temperature by the heating roller 181 and the pressure roller 182 in the standby state is kept to the fixing temperature that is the standby temperature.

The fixing temperature so as to fix the erasable toner to the sheet is lower than the erasing temperature so as to erase the color of the erasable toner. Accordingly, when the erasing mode is designated by a user after the image forming operation or in the standby state, the control unit 27 performs energization control for the heaters 183, 184 so as to raise the heating temperature by the heating roller 181 and the pressure roller 182 up to the erasing temperature.

In addition, the control unit 27 controls conveying of the sheet and halt of conveying of the sheet, based on the detection information of the sheet detecting sensor 25. When the erasing mode is designated by a user, the control unit 27 controls the conveying unit until the heating temperature of the heating unit 18 reaches a prescribed erasing temperature, to make the printed sheet stand by at a specified position in the conveying path 22.

For example, the standby position may be a position just before the heating unit 18. When the standby position is the position just before the heating unit 18, the control unit 27 drives the driving motors of the conveying unit to convey the printed sheet, so that a front edge of the printed sheet reaches the position just before the heating unit 18 until the heating temperature of the heating unit 18 reaches a prescribed erasing temperature. When the front edge of the printed sheet reaches the position just before the heating unit 18, the control unit 27 stops the driving motors of the conveying unit, to make the printed sheet stand by at the position just before. The control unit 27 judges whether or not the heating temperature of the heating unit 18 has reached the prescribed erasing temperature, based on the temperature detection information of the temperature sensors 185, 186. When the control unit 27 judges that the heating temperature of the heating unit 18 has reached the prescribed erasing temperature, the control unit 27 drives the driving motors of the conveying unit again, to feed the printed sheet to the heating unit 18.

The standby position may be the position of the resist rollers 20. When the standby position is the position of the resist rollers 20, the control unit 27 drives the driving motors of the conveying unit to convey the printed sheet, so that the front edge of the printed sheet makes contact with the resist rollers 20 until the heating temperature of the heating unit 18 reaches the prescribed erasing temperature. When the front edge of the printed sheet makes contact with the resist rollers 20 and the tilt of the sheet is adjusted, the control unit 27 stops the driving motors of the conveying unit, to make the printed sheet stand by at the position of the resist rollers 20. When the control unit 27 judges that the heating temperature of the heating unit 18 has reached the prescribed erasing temperature, the control unit 27 drives the driving motors of the conveying unit again, to feed the printed sheet to the heating unit 18.

The standby position may be a specific position in the conveying path 22, for example. The specific position of the conveying path 22 is a position in the conveying path 22 at a more upstream side in the conveying direction of the sheet than the heating unit 18. The specific position of the conveying path 22 may be the sheet feeding cassettes 13, 14, for example. When the standby position is the specific position of the conveying path 22, the control unit 27 predicts an arrival time when the heating temperature of the heating unit 18 reaches the erasing temperature. The control unit 27 drives the driving motors of the conveying unit based on the arrival time, to feed the printed sheet from the specific position of the conveying path 22 that is the standby position to the heating unit 18.

In addition, when the standby position is the sheet feeding cassettes 13, 14, the control unit 27 judges that the heating temperature of the heating unit 18 has reached the prescribed erasing temperature, based on the temperature detection information of the temperature sensors 185, 186, and may feed the printed sheet from the sheet feeding cassettes 13, 14 to the heating unit 18. The standby position of the printed sheet in the erasing mode can arbitrarily be designated by a user.

When the erasing mode is designated by a user, the control unit 27 makes the display unit 16 display a standby position designating screen 161 shown in FIG. 3. As shown in FIG. 3, the standby position designating screen 161 displays a plurality of display portions corresponding to a plurality of the respective positions in the conveying path 22, so as to accept the designation of a standby position by the user. The display portions include a front of heating unit display portion 162, a front of resist roller display portion 163, a prediction conveying display portion 164, and a cassette sheet feeding display portion 165. Each of the display portions 162-165 accepts the designation of the standby position by a touch operation of a user. When each of the display portions 162-165 accepts the designation of the standby position by the user, the display color thereof changes. The standby position designating screen 161 of FIG. 3 shows the state in which the front of heating unit display portion 162 has accepted the designation of the standby position by the user. The display color of the front of heating unit display portion 162 changes into a color different from the display colors of the other display portions 163-165, and as a result, the user can visually recognize that the front of heating unit display portion 162 accepts the designation of the standby position by the user.

The front of heating unit display portion 162 is a button on which the characters of "front of heating unit" are displayed, for example. The front of heating unit display portion 162 accepts user's touch operation so as to designate the standby position to the position just before the heating unit 18. When the front of heating unit display portion 162 accepts the user's touch operation, and the start button 154 accepts the user's touch operation, the control unit 27 controls the conveying unit as described above, to make the printed sheet stand by at the position just before the heating unit 18 that is the standby position. In addition, judging that the heating temperature of the heating unit 18 has reached the erasing temperature, the control unit 27 controls the conveying unit to convey the printed sheet to the heating unit 18.

The front of resist roller display portion 163 is a button on which the characters of "front of resist roller" are displayed, for example. The front of resist roller display portion 163 accepts user's touch operation so as to designate the standby position to the position of the resist rollers 20. When the front of resist roller display portion 163 accepts the user's touch operation, and the start button 154 accepts the user's touch operation, the control unit 27 controls the conveying unit as described above, to make the printed sheet stand by at the position of the resist rollers that is the standby position. In addition, judging that the heating temperature of the heating unit 18 has reached the erasing temperature, the control unit 27 controls the conveying unit to convey the printed sheet to the heating unit 18.

The prediction conveying display portion 164 is a button on which the characters of "prediction conveying" are displayed, for example. The prediction conveying display portion 164 accepts user's touch operation so as to designate the standby position to the specific position of the conveying path 22. When prediction conveying display portion 164 accepts the user's touch operation, and the start button 154 accepts the user's touch operation, the control unit 27 controls the conveying unit as described above, to make the printed sheet stand by at the specific position of the conveying path 22 that is the standby position. In addition, the control unit 27 predicts an arrival time when the heating temperature of the heating unit 18 reaches the erasing temperature, and feeds the printed sheet from the specific position that is the standby position to the heating unit 18 based on the arrival time (hereinafter, may be simply called prediction conveying).

The cassette sheet feeding display portion 165 is a button on which the characters of "cassette sheet feeding" are displayed, for example. The cassette sheet feeding display portion 165 accepts user's touch operation so as to designate the standby position to the sheet feeding cassettes 13, 14. When the cassette sheet feeding display portion 165 accepts the user's touch operation, and the start button 154 accepts the user's touch operation, the control unit 27 judges whether or not the heating temperature of the heating unit 18 has reached the erasing temperature, as described above. Judging that the heating temperature of the heating unit 18 has reached the erasing temperature, the control unit 27 controls the conveying unit as described above, to take out the printed sheet from the sheet feeding cassettes 13, 14 and feed the printed sheet to the heating unit 18.

In the erasing mode, since a toner image is not transferred at the secondary transfer position 21, a front edge of the printed sheet passes through the secondary transfer position, and the printed sheet can be made to reach the position just before the heating unit 18, for example. Accordingly, according to the image forming apparatus 10 of the embodiment, the printed sheet can be passed to the heating unit 18 immediately after the heating temperature of the heating unit 18 reaches the prescribed temperature, and as a result, the efficiency of the erasing processing can be improved.

FIG. 4A-FIG. 4E are flow charts showing conveying control of a sheet when an image forming mode and an erasing mode are designated by a user.

In an Act 1, the image forming apparatus 10 is in a standby state. In other words, a heating temperature of the heating unit 18 is a fixing temperature lower than an erasing temperature. When the operation unit 15 accepts the designation of the image forming mode, and accepts a start instruction, the operation of the image forming apparatus 10 proceeds to an Act 2. When the operation unit 15 accepts the designation of the erasing mode, and accepts a start instruction, the operation of the image forming apparatus 10 proceeds to an Act 3.

In the Act 2, the heating unit 18 functions as a fixing unit. The heating temperature of the heating unit 18 is the fixing temperature in the standby state. Accordingly, the control unit 27 does not raise the heating temperature of the heating unit 18. The control unit 27 controls the conveying unit, to take out a sheet from any one of the sheet feeding cassettes 11, 12. Guided with the conveying path 22, the sheet is conveyed to the resist rollers 20. The control unit 27 stops the rotation of the resist rollers 20. After the sheet makes contact with the resist rollers 20 and the tilt thereof is adjusted, the sheet stops. The control unit 27 rotates the resist rollers 20 in accordance with the image forming timing of the image forming unit 17. The sheet is conveyed to the transfer position 21 by the resist rollers 20. At the transfer position 21, the secondary transfer roller 29 transfers an erasable toner image supported on the transfer belt 26 to the sheet. The sheet on which the erasable toner image has been transferred is conveyed to the heating unit 18 by the conveying roller 223, the resist rollers 20, and the secondary transfer roller 29 which compose the conveying unit. The heating unit 18 heats and pressurizes the unfixed position just before the heating unit 18, the operation of the image forming apparatus 10 proceeds to an Act 4. When the control unit 27 judges that the standby position is not designated to the position just before the heating unit 18, the operation of the image forming apparatus 10 proceeds to an Act 6.

In the Act 4, the control unit 27 controls the sheet feeding unit 23 that is the conveying unit, to take out the printed sheet from the sheet feeding cassettes 13, 14. The control unit 27 further controls the conveying roller 223, the resist rollers 20, the secondary transfer roller 29 that are the conveying unit, to convey the printed sheet to the position just before the heating unit 18 that is the standby position, and to make the sheet stand by erasable toner image by the heating roller 181 and the pressure roller 182, to fix the toner image on the sheet. The sheet discharge roller 221 discharges the printed sheet on which the erasable toner image has been fixed to the sheet discharge unit 19. The sheet discharge unit 19 loads the printed sheet.

In the Act 3, the heating unit 18 functions as an erasing unit. The control unit 27 performs energization control of the heaters 183, 184, to raise the heating temperature of the heating unit 18 from the standby temperature toward the erasing temperature. In addition, the control unit 27 judges whether or not the standby position of the printed sheet is designated to the position just before the heating unit 18. When the control unit 27 judges that the standby position is designated to the there. In addition, the control unit 27 waits based on the detection information of the temperature sensors 185, 186, until the heating temperature of the heating unit 18 reaches the prescribed erasing temperature. When the control unit 27 judges that the heating temperature of the heating unit 18 has reached the prescribed erasing temperature based on the detection information of the temperature sensors 185, 186, the operation of the image forming apparatus 10 proceeds to an Act 5.

In the Act 5, the front edge of the printed sheet which stands by at the standby position is located at the position just before the heating unit 18. In addition, the printed sheet is nipped in the nip portion of the secondary transfer roller 29 and the transfer belt 26. The control unit 27 controls the conveying unit to rotate the conveying roller 223, the transfer belt 26 and the secondary transfer roller 29, to feed the printed sheet to the heating unit 18. Since the heating temperature has reached the erasing temperature, the heating unit 18 heats and pressurizes the image on the printed sheet to be passed by the heating roller 181 and the pressure roller 182, to erase the image. The sheet discharge roller 221 discharges the sheet from which the erasable toner image has been erased to the sheet discharge unit 19. The sheet discharge unit 19 loads the sheet from which the erasable toner image has been erased.

In the Act 6, the control unit 27 judges whether or not the standby position of the printed sheet is designated to the position of the resist rollers 20. When the control unit 27 judges that the standby position is designated to the position of the resist rollers 20, the operation of the image forming apparatus 10 proceeds to an Act 7. When the control unit 27 judges that the standby position is not designated to the position of the resist rollers 20, the operation of the image forming apparatus 10 proceeds to an Act 9.

In the Act 7, the control unit 27 controls the sheet feeding unit 23 that is the conveying unit, to take out the printed sheet from the sheet feeding cassettes 13, 14. The control unit 27 further controls the conveying roller 223 and so on that are the conveying unit, to convey the printed sheet to the position of the resist rollers 20 that is the standby position, and to make the sheet stand by. In addition, the control unit 27 waits based on the detection information of the temperature sensors 185, 186 until the heating temperature of the heating unit 18 reaches the prescribed erasing temperature. When the control unit 27 judges that the heating temperature of the heating unit 18 has reached the prescribed erasing temperature based on the detection information of the temperature sensors 185, 186, the operation of the image forming apparatus 10 proceeds to an Act 8.

In the Act 8, the control unit 27 controls the conveying unit to rotate the conveying roller 223, the resist rollers 20, the transfer belt 26 and the secondary transfer roller 29, to feed the printed sheet to the heating unit 18. The heating unit 18 heats and pressurizes the image of the printed sheet to be passed by the heating roller 181 and the pressure roller 182, to erase the image. The sheet discharge roller 221 discharges the sheet from which the erasable toner image has been erased to the sheet discharge unit 19. The sheet discharge unit 19 loads the sheet from which the erasable toner image has been erased.

In the Act 9, the control unit 27 judges whether or not the prediction conveying is designated. When the control unit 27 judges that the prediction conveying is designated, the operation of the image forming apparatus 10 proceeds to an Act 10. When the control unit 27 judges that the prediction conveying is not designated, the operation of the image forming apparatus 10 proceeds to an Act 13.

In the Act 10, the control unit 27 controls the sheet feeding unit 23 that is the conveying unit, to take out the printed sheet from the sheet feeding cassettes 13, 14. The control unit 27 further controls the conveying roller 223 and so on that are the conveying unit, to convey the printed sheet to the specific position of the conveying path 22 that is the standby position, and to make the sheet back up. In addition, the control unit 27 grasps the present heating temperature of the heating unit 18 based on the temperature detection information of the temperature detection sensors 185, 186, and predicts an arrival time when the heating temperature of the heating unit 18 will reach the erasing temperature. The control unit 27 determines a sheet feeding start time to feed the printed sheet from the standby position to the heating unit 18, based on the arrival time. Specifically, the control unit 27 further grasps the present position of the printed sheet based on the detection information of the sheet detecting sensor 25. When the printed sheet stands by at the standby position, the present position is the standby position. The control unit 27 calculates a conveying time required for conveying the printed sheet from the present position to the heating unit 18, based on a distance from the present position of the printed sheet to the heating unit 18, and a conveying speed of the printed sheet. The control unit 27 determines the sheet feeding start time to feed the printed sheet from the standby position to the heating unit 18, based on the arrival time and the conveying time. The control unit 27 determines the sheet feeding start time so that the printed sheet reaches the heating unit 18 at the same time when the heating temperature of the heating unit 18 reaches the erasing temperature. When the control unit 27 determines the sheet feeding start time, the operation of the image forming apparatus 10 proceeds to an Act 11.

In the Act 11, the control unit 27 waits until it becomes the sheet feeding start time. When the control unit 27 judges that it becomes the sheet feeding start time, the operation of the image forming apparatus 10 proceeds to an Act 12.

In the Act 12, the control unit 27 controls the conveying roller 223 and so on that are the conveying unit, to start feeding the printed sheet from the specific position of the conveying path 22 that is the standby position, and to convey the printed sheet to the heating unit 18. The specific position of the conveying path 22 is the position at the more upstream side in the sheet conveying direction than the heating unit 18 in the conveying path 22, as described above. Since the sheet feeding start time is determined so that the printed sheet reaches the heating unit 18 at the same time when the heating temperature of the heating unit 18 reaches the erasing temperature, the printed sheet is passed to the heating unit 18 whose heating temperature has just reached the erasing temperature. Accordingly, the heating unit 18 heats and pressurizes the image of the printed sheet to be passed by the heating roller 181 and the pressure roller 182, to erase the image. The sheet discharge roller 221 discharges the sheet from which the erasable toner image has been erased to the sheet discharge unit 19. The sheet discharge unit 19 loads the sheet from which the erasable toner image has been erased.

In the Act 13, the control unit 27 waits based on the detection information of the temperature sensors 185, 186 until the heating temperature of the heating unit 18 reaches the erasing temperature. When the control unit 27 judges that the heating temperature of the heating unit 18 has reached the prescribed erasing temperature based on the detection information of the temperature sensors 185, 186, the operation of the image forming apparatus 10 proceeds to an Act 14.

In the Act 14, the control unit 27 controls the sheet feeding unit 23 that is the conveying unit, to take out a printed sheet from the sheet feeding cassettes 13, 14. The control unit 27 further controls the conveying roller 223 and so on that are the conveying unit, to convey the printed sheet to the heating unit 18. The heating unit 18 heats and pressurizes the image of the printed sheet to be passed by the heating roller 181 and the pressure roller 182, to erase the image. The sheet discharge roller 221 discharges the sheet from which the erasable toner image has been erased to the sheet discharge unit 19. The sheet discharge unit 19 loads the sheet from which the erasable toner image has been erased.

The conveying control of a printed sheet in the erasing mode described above is one of conveying control when an image of one printed sheet is erased and conveying control of a first printed sheet when images of a plurality of sheets are erased consecutively. Conveying control of a second and subsequent printed sheets when images of a plurality of sheets are erased consecutively, for example, is as follows. When a subsequent printed sheet (a second printed sheet, for example) whose image is to be erased exists, the control unit 27 judges whether or not the heating temperature of the heating unit 18 is not less than the erasing temperature after an image of a printed sheet conveyed previously (a first printed sheet, for example) has been erased, and controls the conveying of the second and subsequent printed sheets based on the judging result. Specifically, after the operation of the Act 5, or the Act 8, or the Act 12, or the Act 14 is finished, the control unit 27 judges whether or not a subsequent printed sheet (a second printed sheet) whose image is to be erased exists. When the subsequent printed sheet (the second printed sheet) whose image is to be erased exists, the control unit 27 judges whether or not the heating temperature of the heating unit 18 is not less than the erasing temperature after an image of a printed sheet conveyed previously (a first printed sheet) has been erased, based on the temperature detection information of the temperature detection sensors 185, 186. When the control unit 27 judges that the heating temperature of the heating unit 18 is not less than the erasing temperature, the control unit 27 controls the conveying unit so as not to make the printed sheet to be subsequently conveyed (the second printed sheet) stand by at the standby position, but to convey the sheet to the heating unit 18 following the printed sheet to be previously conveyed (the first printed sheet). When the control unit 27 judges that the heating temperature of the heating unit 18 is lower than the erasing temperature, the operation of the image forming apparatus 10 returns to the Act 3, for example.

In the Act 3, the control unit 27 performs energization control of the heaters 183, 184, to raise the heating temperature of the heating unit 18 from the standby temperature toward the erasing temperature, as described above. In addition, the control unit 27 judges whether or not the standby position of the printed sheet is designated to the position just before the heating unit 18. When the control unit 27 judges that the standby position is designated to the position just before the heating unit 18, the operation of the image forming apparatus 10 proceeds to the Act 4. When the control unit 27 judges that the standby position is not designated to the position just before the heating unit 18, the operation of the image forming apparatus 10 proceeds to the Act 6. The following conveying control of the printed sheet is performed in accordance with the above-described flow charts shown in FIGS. 4B-4E. The control unit 27 repeats the sheet conveying control until the subsequent printed sheet whose image is to be erased is not present.

According to the image forming apparatus 10 of the embodiment, the standby position of a printed sheet can be designated. For example, the standby position of a printed sheet can be designated to any position out of a position just before the heating unit 18, the position of the resist rollers 20, a specific position of the conveying path, and the position of the sheet feeding cassette. Accordingly, in order to effectively perform erasing processing to a printed sheet, the sheet can be conveyed to the heating unit 18. In addition, according to the image forming apparatus 10 of the embodiment, the erasing processing can be performed at an optimum erasing temperature.

In addition, when the erasing processing is performed for a plurality of printed sheets, the heating temperature of the heating unit 18 may sometimes becomes lower than the erasing temperature in the middle of the consecutive erasing processing. According to the image forming apparatus of the embodiment, when the heating temperature of the heating unit 18 becomes lower than the erasing temperature in the middle of the consecutive erasing processing, the printed sheet is made to stand by at the standby position. Accordingly, when the heating temperature of the heating unit 18 returns to the erasing temperature, the printed sheet can be effectively conveyed to the heating unit 18.

In the prediction conveying, the control unit 27 determined the sheet feeding start time of the printed sheet from the standby position so that the printed sheet reaches the heating unit 18 at the same time when the heating temperature of heating unit 18 reaches the erasing temperature. In other words, before the heating temperature of the heating unit 18 reaches the erasing temperature, feeding the printed sheet from the standby position was started. However, the prediction conveying of the embodiment is not limited to the sheet feeding start control described above. For example, the control unit 27 predicts an arrival time when the heating temperature of the heating unit 18 reaches the erasing temperature, and may control the conveying unit so as to start feeding the printed sheet from the standby position when it becomes the arrival time. In addition, the standby position of the printed sheet may be a position just before the heating unit, or the position of the resist rollers, or the sheet feeding cassettes, for example, as long as the standby position is a position at the more upstream side in the sheet conveying direction than the heating unit. Even if the standby position of the printed sheet is any position at the more upstream side in the conveying direction than the heating unit, the printed sheet can be conveyed so that the printed sheet reaches the heating unit 18 at the same time when the heating temperature of the heating unit 18 reaches the erasing temperature.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus having an image forming function to form an image on a recording medium, and an image erasing function to erase an image formed on a recording medium, the image forming apparatus, comprising:

an image forming unit configured to form an image with coloring material whose color is erasable;

a heating unit configured to heat the image at a fixing temperature when the image formed by the image forming unit is fixed on a recording medium and to heat the image at an erasing temperature higher than the fixing temperature when color of an image previously fixed on a recording medium is erased;

a conveying unit configured to convey the recording medium to the heating unit through a prescribed conveying path; and a control unit configured to control the conveying unit so that when the color of the image is erased, and also when a heating temperature of the heating unit is lower than the erasing temperature, the recording medium is made to once stand by at a specific standby position at a more upstream side in a direction of conveying the recording medium than the heating unit, and after the standby, the recording medium is fed from the specific standby position to the heating unit.

2. The image forming apparatus as recited in claim 1, wherein the conveying unit comprises a transfer roller which is provided at a position at the more upstream side in the direction of conveying the recording medium than the heating unit in the conveying path, and transfers the image formed by the image forming unit on the recording medium, and a resist roller which is provided at a position at the more upstream side in the direction of conveying the recording medium than the transfer roller in the conveying path and conveys the recording medium to the transfer roller in accordance with an image forming timing by the image forming unit, and the specific standby position is the position of the resist roller.

3. The image forming apparatus as recited in claim 1, wherein the control unit predicts an arrival time when the heating temperature of the heating unit reaches the erasing temperature, and controls the conveying unit so as to start feeding the recording medium from the specific standby position toward the heating unit based on the predicted arrival time.

4. The image forming apparatus as recited in claim 3, wherein the control unit controls the conveying unit so as to start feeding the recording medium from the specific standby position to the heating unit at the predicted arrival time.

5. The image forming apparatus as recited in claim 3, wherein the control unit controls the conveying unit so as to start feeding the recording medium from the specific standby position at a time earlier than the predicted arrival time.

6. The image forming apparatus as recited in claim 5, wherein the control unit controls the conveying unit so that the recording medium reaches the heating unit at the same time when the heating temperature of the heating unit reaches the erasing temperature.

7. The image forming apparatus as recited in claim 1, further comprising a temperature sensor to detect the heating temperature of the heating unit, wherein the control unit controls the conveying unit so as to start feeding the recording medium from the specific standby position toward the heating unit, when the control unit judges that the heating temperature of the heating unit has reached the erasing temperature based on temperature detection information of the temperature sensor.

8. The image forming apparatus as recited in claim 1, further comprising a display unit to display a standby position designating screen for accepting designation of the specific standby position out of a plurality of the positions of the conveying path.

9. The image forming apparatus as recited in claim 1, wherein when the colors of the images of a plurality of the recording mediums are consecutively erased, the control unit controls the conveying unit so as to make a first one of the recording mediums conveyed by the conveying unit stand by at the specific standby position, and feed the recording medium from the specific standby position to the heating unit after the standby.

10. The image forming apparatus as recited in claim 9, wherein the control unit controls the conveying unit so that when the heating temperature of the heating unit is not less than the erasing temperature after the image of the recording medium to be previously conveyed by the conveying unit has been erased, the recording medium to be subsequently conveyed by the conveying unit is conveyed to the heating unit without being made to stand by at the specific standby position, and when the heating temperature of the heating unit is lower than the erasing temperature after the image of the recording medium to be previously conveyed has been erased, the recording medium to be subsequently conveyed is made to stand by at the specific standby position.

* * * * *